US008454352B2

(12) United States Patent
Whitford et al.

(10) Patent No.: US 8,454,352 B2
(45) Date of Patent: Jun. 4, 2013

(54) MICRO-PILOT FOR GAS APPLIANCE

(75) Inventors: Geoffrey Mervyn Whitford, Sydney (AU); Brendon John Ruwoldt, Sydney (AU)

(73) Assignee: Invensys Controls Australia Pty Ltd., Pendle Hill (AU)

( * ) Notice: Subject to any disclaimer, the term of this patent is extended or adjusted under 35 U.S.C. 154(b) by 956 days.

(21) Appl. No.: 12/175,504

(22) Filed: Jul. 18, 2008

(65) Prior Publication Data

US 2010/0015559 A1 Jan. 21, 2010

(51) Int. Cl.
*F23Q 9/08* (2006.01)

(52) U.S. Cl.
USPC ..... 431/61; 431/60; 431/62; 431/42; 431/43; 431/44; 431/72; 431/75

(58) Field of Classification Search
USPC ..... 431/42–44, 60–61, 75
See application file for complete search history.

(56) References Cited

U.S. PATENT DOCUMENTS

| | | | | | |
|---|---|---|---|---|---|
| 1,581,712 | A | * | 4/1926 | Yoder | 236/102 |
| 1,699,297 | A | * | 1/1929 | Ledbetter | 138/44 |
| 1,715,650 | A | * | 6/1929 | Fonseca | 431/58 |
| 1,813,395 | A | | 7/1931 | Fraser | |
| 1,842,337 | A | | 1/1932 | Te Pas | |
| 1,856,489 | A | * | 5/1932 | Lonergan et al. | 431/42 |
| 1,856,502 | A | * | 5/1932 | Morley et al. | 431/42 |
| 1,864,515 | A | * | 6/1932 | Beadle et al. | 431/283 |
| 1,949,030 | A | * | 2/1934 | Stockmeyer | 431/52 |
| 1,968,319 | A | | 7/1934 | Shively | |
| 2,005,224 | A | * | 6/1935 | Dunham et al. | 237/2 R |
| 2,139,344 | A | * | 12/1938 | Andersen | 236/1 E |
| 2,196,316 | A | * | 4/1940 | Long | 236/23 |
| 2,265,210 | A | * | 12/1941 | Waddell | 236/80 R |
| 2,297,763 | A | * | 10/1942 | Higley et al. | 96/109 |

(Continued)

FOREIGN PATENT DOCUMENTS

| | | | |
|---|---|---|---|
| CA | 2409271 | A1 | 4/2003 |
| CA | 2426723 | A1 | 7/2003 |

(Continued)

OTHER PUBLICATIONS

U.S. Appl. No. 12/687,159, Whitford et al.

(Continued)

*Primary Examiner* — Kenneth Rinehart
*Assistant Examiner* — Jorge Pereiro
(74) *Attorney, Agent, or Firm* — Reinhart Boerner Van Deuren, P.C.

(57) ABSTRACT

A micro pilot for a gas hot water heater is provided. The micro pilot provides a flame that is substantially smaller than a typical pilot in a hot water heater during standby operation of the burner. Just prior to allowing gas to flow to the burner upon a call for heat, a pilot flame of sufficient size to ensure ignition of the burner is provided. In one embodiment this larger pilot flame is produced by providing an additional amount of bleed gas to the pilot to increase flame size. In another embodiment, bleed gas is provided to a separate booster pilot, which is ignited by the micro pilot. The flame from the booster pilot is then used to ignite the main burner. This design allows for the micro pilot to be positioned closer to the flame trap of a flammable vapor resistant hot water heater to ensure smooth ignition of any such vapor.

20 Claims, 7 Drawing Sheets

U.S. PATENT DOCUMENTS

| | | | | | |
|---|---|---|---|---|---|
| 2,384,314 | A | * | 9/1945 | Koppel | 431/56 |
| 2,437,894 | A | * | 3/1948 | Ray | 431/44 |
| 2,478,386 | A | * | 8/1949 | Gauger | 431/54 |
| 2,513,578 | A | * | 7/1950 | Matthews | 431/59 |
| 2,513,705 | A | * | 7/1950 | Arden | 431/52 |
| 2,516,333 | A | * | 7/1950 | Moore | 137/84 |
| 2,592,952 | A | * | 4/1952 | Ray | 236/68 B |
| 2,635,637 | A | * | 4/1953 | Karrer | 251/57 |
| 2,703,095 | A | * | 3/1955 | Ray | 137/66 |
| 2,752,870 | A | * | 7/1956 | Short et al. | 110/187 |
| 2,765,029 | A | * | 10/1956 | Wolff | 431/52 |
| 2,833,304 | A | * | 5/1958 | Fish | 137/495 |
| 2,916,088 | A | * | 12/1959 | Scogin | 431/280 |
| 2,939,524 | A | * | 6/1960 | Mathis et al. | 236/99 R |
| 2,953,198 | A | | 9/1960 | Hajny | |
| 2,986,207 | A | * | 5/1961 | Scogin | 431/283 |
| 3,159,202 | A | * | 12/1964 | Weber | 431/60 |
| 3,166,248 | A | | 1/1965 | Fleer | |
| 3,167,248 | A | * | 1/1965 | Douglas | 236/15 A |
| 3,171,468 | A | * | 3/1965 | Sparrow | 431/59 |
| 3,213,922 | A | * | 10/1965 | Weber | 431/42 |
| 3,240,241 | A | * | 3/1966 | Kenney | 141/217 |
| 3,308,871 | A | * | 3/1967 | Riehl | 431/42 |
| 3,314,604 | A | * | 4/1967 | Branson | 236/80 R |
| 3,330,133 | A | * | 7/1967 | Kniebes | 431/60 |
| 3,344,989 | A | * | 10/1967 | Willson | 236/99 R |
| 3,391,867 | A | * | 7/1968 | Zulian | 236/15 A |
| 3,402,889 | A | * | 9/1968 | Willson | 236/80 R |
| 3,405,999 | A | | 10/1968 | Riehl | |
| 3,447,775 | A | * | 6/1969 | Katchka et al. | 251/45 |
| 3,469,567 | A | * | 9/1969 | Bergquist | 126/39 R |
| 3,477,462 | A | * | 11/1969 | Ray | 137/489 |
| 3,526,360 | A | * | 9/1970 | Ray | 236/68 R |
| 3,528,452 | A | * | 9/1970 | Willson | 137/495 |
| 3,597,138 | A | * | 8/1971 | Ray | 431/54 |
| 3,619,095 | A | * | 11/1971 | Genbauffe | 431/42 |
| 3,692,239 | A | * | 9/1972 | Genbauffe | 236/15 A |
| 3,754,563 | A | * | 8/1973 | Boals | 137/94 |
| 3,809,313 | A | * | 5/1974 | Branson | 236/15 A |
| 3,872,877 | A | * | 3/1975 | Branson | 137/118.07 |
| 3,989,188 | A | * | 11/1976 | Branson | 236/15 A |
| 3,999,932 | A | * | 12/1976 | Matthews | 431/16 |
| 4,060,192 | A | * | 11/1977 | Branson | 236/46 D |
| 4,076,171 | A | | 2/1978 | Swenson | |
| 4,131,413 | A | | 12/1978 | Ryno | |
| 4,159,800 | A | * | 7/1979 | Branson et al. | 236/15 A |
| 4,164,936 | A | | 8/1979 | Dottore, Jr. | |
| 4,182,483 | A | | 1/1980 | Swenson | |
| 4,192,310 | A | | 3/1980 | Brodin | |
| 4,204,833 | A | | 5/1980 | Kmetz et al. | |
| 4,225,080 | A | | 9/1980 | Barth | |
| 4,264,296 | A | | 4/1981 | Folkerts | |
| 4,266,929 | A | | 5/1981 | Swenson | |
| 4,285,662 | A | * | 8/1981 | Katchka et al. | 431/53 |
| 4,289,271 | A | | 9/1981 | Barth | |
| 4,298,336 | A | * | 11/1981 | Riehl | 431/264 |
| RE30,936 | E | | 5/1982 | Kmetz et al. | |
| 4,386,731 | A | | 6/1983 | Barth | |
| 4,408,567 | A | | 10/1983 | Morton | |
| 4,413,975 | A | | 11/1983 | Turner et al. | |
| 4,770,160 | A | | 9/1988 | Schimmeyer | |
| 4,778,378 | A | | 10/1988 | Dolnick et al. | |
| 5,039,006 | A | | 8/1991 | Habegger | |
| 5,039,300 | A | * | 8/1991 | Riehl | 431/354 |
| 5,102,039 | A | * | 4/1992 | Yothers | 236/15 A |
| 5,121,899 | A | * | 6/1992 | Willson | 251/30.02 |
| 5,239,947 | A | | 8/1993 | Schimmeyer | |
| 5,275,555 | A | * | 1/1994 | Goodridge | 431/343 |
| 5,393,221 | A | | 2/1995 | McNally | |
| 5,447,125 | A | | 9/1995 | McNally et al. | |
| 5,682,841 | A | | 11/1997 | Schimmeyer et al. | |
| 5,732,692 | A | | 3/1998 | Schimmeyer | |
| 5,911,217 | A | | 6/1999 | Dameworth | |
| 6,418,883 | B2 | | 7/2002 | Bourke et al. | |
| 6,546,897 | B1 | | 4/2003 | Edds et al. | |
| 6,584,940 | B1 | | 7/2003 | Khadkikar et al. | |
| 6,684,821 | B2 | * | 2/2004 | Lannes et al. | 122/14.2 |
| 7,311,064 | B2 | | 12/2007 | Schimmeyer | |
| 2005/0066958 | A1 | | 3/2005 | Guzorek | |

FOREIGN PATENT DOCUMENTS

| | | | |
|---|---|---|---|
| CA | 2482509 | A1 | 3/2005 |
| EP | 0019671 | A1 | 5/1979 |
| GB | 528827 | | 11/1940 |
| GB | 942650 | | 11/1963 |
| GB | 953982 | | 4/1964 |
| GB | 1 475 133 | | 6/1977 |
| JP | 56119420 | | 9/1981 |
| JP | 57188950 | | 11/1982 |
| JP | 58033050 | | 2/1983 |
| JP | 59157422 | | 9/1984 |
| JP | 60-226623 | | 11/1985 |
| JP | 62063140 | | 3/1987 |
| JP | 63021404 | | 1/1988 |
| JP | 4045320 | | 2/1992 |
| JP | 2007232262 | | 9/2007 |
| WO | WO 95/17631 | A1 | 6/1995 |
| WO | WO 00/40906 | A2 | 7/2000 |
| WO | WO 2006/135319 | A1 | 12/2006 |

OTHER PUBLICATIONS

U.S. Appl. No. 12/175,551, Whitford et al, Jul. 18, 2008.

S. K. Sarkar, Flame traps-a technical note, journal, Jul. 1987, 5 pages, pp. 323-327, Journal of Mines, Metals & Fuels.

J. A. Harris et al., Flame stability-principles and practice, journal, Mar. 10, 1978, 22 pages, London and Southern Junior Gas Association.

Ken Lapp et al., Detonation Flame Arrester Qualifying Application Parameter for Explosion Prevention in Vapor Handling Systems, paper, Apr. 1995, 8 pages, pp. 139-146, Process Safety Progress (vol. 14, No. 2), Westech Industrial Ltd., 5636 Burbank Crescent , S.E., Calgary, Alberta, Canada T2H 1Z6.

R. P. Wilson et al., Flame Arrestor Design Requirements for Prolonged Exposure to Methane/Air, and Gasoline/Air Flames, report, Sep. 1978, 53 pages, Report No. CG-D-73-78, U.S. Department of Transportation, United States Coast Guard, Office of Research and Development, Washington, D.C. 20590.

* cited by examiner

MICRO-PILOT FOR GAS APPLIANCE

FIELD OF THE INVENTION

This invention generally relates to energy conservation systems, and more particularly to energy conservation systems to be employed with gas burning appliances to reduce the amount of gas used by a pilot while ensuring proper burner and flammable vapor ignition.

BACKGROUND OF THE INVENTION

It has now been recognized that the world's environment is suffering too much from global warming caused by greenhouse gas exposure in the atmosphere. To address this problem governments are now starting to adopt targets for reducing the emission of greenhouse gases to the environment and play their part to address this problem for future generations. While some countries have not adopted a firm goal, other countries, for example Australia, have adopted a policy for the reducing greenhouse gases by 20% by the year 2020.

Greenhouse gases can be emitted from cars, industry, farming, and households to name a few. While certainly not as apparent as a large factory with tall smokestacks, within a normal household the gas burning appliances, such as furnaces, water heaters, etc., all release such greenhouse gases as a by-product of the combustion process itself. While the appliance industry has taken a leading role in energy efficiency and environmental concern, further improvement is always foremost in mind of the appliance design engineer.

With such further improvement in mind, especially with the increased awareness of global climate change and changing governmental regulations, it is noted that hot water heaters, both internal and externally installed units, can be one of the more fairly inefficient appliances in energy conservation, and therefore require the burning of additional fuel to maintain the set point temperature. This, of course, results in the additional production of greenhouse gas beyond that which a more efficient appliance would produce.

A typical hot water heater includes a vertical tank with a centrally located flue pipe. A gas burner is positioned underneath the tank and is controlled by a combination gas controller valve. The combination gas controller valve incorporates an On/Off valve, a pilot safety circuit, pilot and main burner pressure regulators and their associated supply pipe connections, as well as a thermostat to control the hot water heater to maintain the water in the storage tank at a predetermined temperature.

Upon the thermostat calling for more heat, the main gas valve opens to allow gaseous fuel (gas) to flow to the main burner where it is ignited by the pilot light. Ignition and combustion of the gas results in hot flue gas being generated. The heat from the hot flue gases is transferred to the cold water via the bottom of the tank and through the walls of the central flue pipe. The flue gases exit out the top of the hot water heater.

There are generally two types of hot water heaters used throughout the world classified by their installation location. For an indoor water heater such as used in the North American market, the hot flue gases exit through a draft diverter that is connected to a flue pipe which pipes the flue gases safety to an outside location. Air for combustion of the gas is drawn into the combustion chamber at the bottom of the hot water heater. For an outdoor hot water heater such as used in the Australian market, the flue gases pass safely through a balanced flue terminal at the top of the heater to the outside atmosphere. The balanced flue terminal is so designed to allow a continuous supply of air for combustion irrespective whether the burner is on or off under all types of wind conditions. The air for combustion is transferred to the bottom of the heater internally within the appliance.

For each of these two types of hot water heaters, many manufacturers are offering configurations that are flammable vapor resistant. Flammable vapor resistant hot water heaters normally have a flame trap in the bottom of the combustion chamber as the fresh air inlet. The flame trap is a special design to allow air for normal combustion and also any flammable vapors to enter the combustion chamber. Such flammable vapors may be the result of an accidental gasoline spill, for example. The design is such that any resultant ignition/explosion due to flammable vapors (e.g. gasoline) in the combustion chamber will not escape the appliance and ignite the spill outside the appliance. Such designs have recently been mandated in the United States.

As a result of the two requirements, i.e. ensuring ignition of the main burner upon a call for heat and safely igniting any flammable vapor that enters the air intake, the positioning of the pilot and the size of the pilot flame itself become very important.

Unfortunately, one of the current disadvantages for hot water heaters is the overall service efficiency of the appliances. Service efficiency is defined as the energy delivered to the hot water from the hot water heater each day, divided by the energy burnt in the gas to heat the water and to maintain the hot water in the tank at the desired temperature. The service efficiency may vary from around 0.50 or 50% for poor performing appliances, to appliances just complying to US regulations around 0.59, to superior products from 0.64 or 64% service efficiency. Low service efficiency may be due to poor thermal efficiency of the heat into the water when the burner is on and/or excessive heat losses when the burner is off. Since the main burner is only on for one to two hours per day heating the stored water to keep it ready for use, burning of gas for the pilot for the remaining 22 hours only contributes to the inefficiency issues.

As is clear from the foregoing, there is a need in the art for a pilot control system for a hot water heater that conserves energy and yet still ensures ignition of the main burner and safe ignition of flammable vapor. Embodiments of the present invention provides such a pilot control system. These and other advantages of the invention, as well as additional inventive features, will be apparent from the description of the invention provided herein.

BRIEF SUMMARY OF THE INVENTION

In view of the above, embodiments of the present invention provide a new and improved energy saving pilot for a hot water heater or other gas burning appliance. More particularly, embodiments of the present invention provide a new and improved pilot for a hot water heater or other gas burning appliance that not only saves energy and reduces greenhouse gas emissions, but also ensure ignition of the main burner and safe ignition of flammable vapor.

In one embodiment, the invention utilizes bleed gas from a safety relay valve to increase the size of the pilot flame just prior to opening a main flow of gas to the burner from a micro-pilot flame size to an ignition flame size when the hot water heater's main combination gas controller calls for heat. This allows for a smaller amount of gas to be used for the pilot to operate it as a micro-pilot during the periods when the burner is off with no call for heat and will ensure ignition of the main gas flow to the burner when a call for heat has been issued. The smaller or micro-pilot flame will also provide smoother ignition of gasoline fumes in Flammable Vapor Resistant heaters.

In another embodiment, the invention utilizes a physically separate micro-pilot and a booster or ignition pilot that is operated from bleed gas from a safety relay valve. The bypass gas flow to the booster pilot will occur just prior to opening the main flow of gas to the burner. The micro-pilot flame will ignite the booster pilot supplied with the bypass gas, which will then ignite the main gas flow to the burner. This allows for a smaller amount of gas to be used for the pilot to operate it as a micro-pilot during the periods when the burner is not on and will ensure ignition of the main gas flow to the burner when a call for heat has been issued. The smaller or micro-pilot flame will also provide smoother ignition of gasoline fumes in Flammable Vapor Resistant heaters.

In each embodiment, the micro-pilot is sized to be large enough to provide enough heat to the safety thermocouple to keep the gas pilot safety valve open in a typical hot water heater or other gas burning appliance combination gas controller. It is also sized to be large enough to resist air turbulence due to ignition and combustion of the natural gas from the main burner. Embodiments of the present invention are also positioned so that smooth ignition results to the main burner and to any flammable vapor. Rough ignition of flammable vapor will normally result in a small explosion in the combustion chamber forcing the flame front through the flame trap, possibly igniting the gasoline outside the water heater which could result in a larger explosion and a household fire. Embodiments of the present invention position the pilot flame for ignition relatively closer to the burner for low NOx burners to obtain smooth ignition.

Using bleed gas to boost the pilot size or to supply a booster pilot just prior to ignition of the main burner in accordance with embodiments of the present invention gives improved performance on ignition and saves gas. It allows the potential to reduce the normal size of the pilot size by way of example only approximately 50% thus saving around 4.8 Mj/day (4500 Btu/day) energy.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
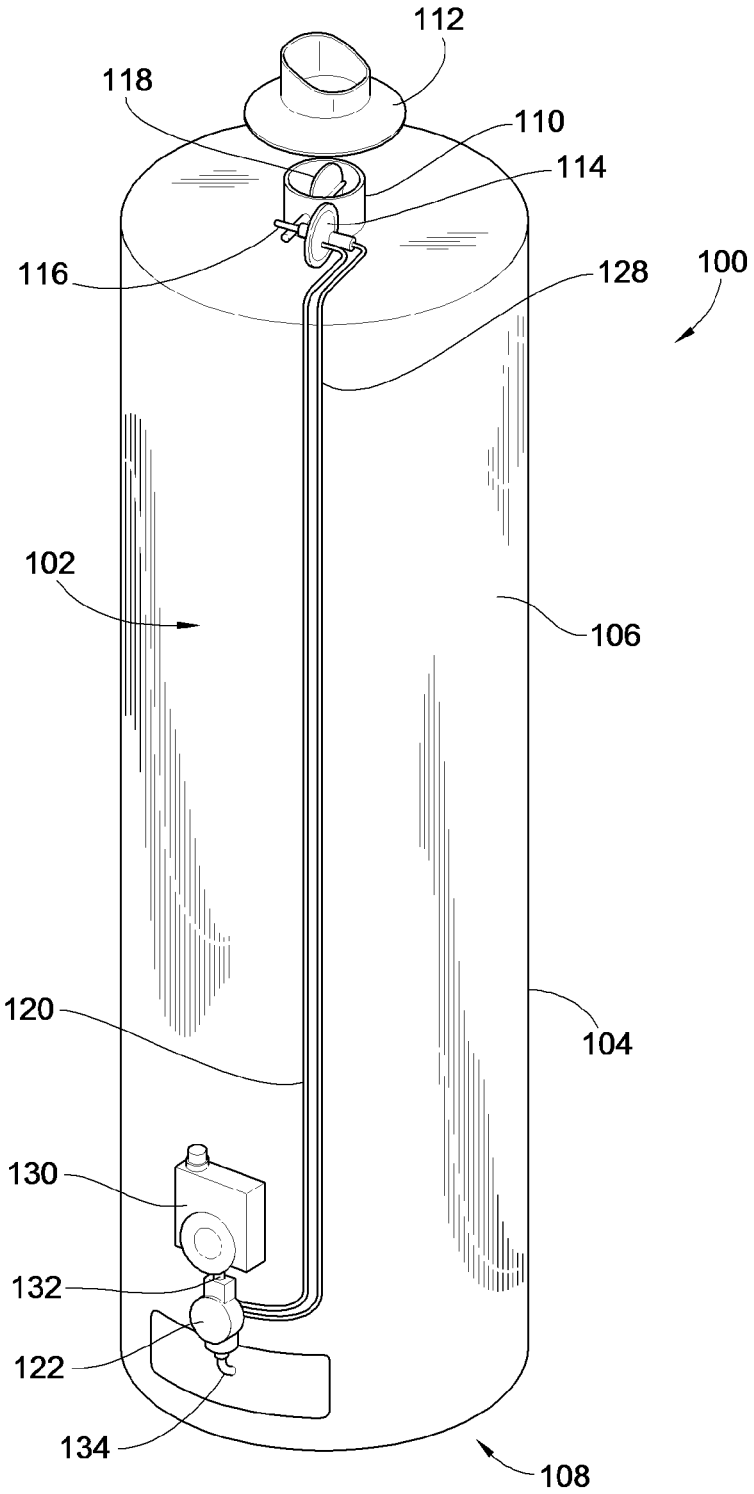
FIG. 1 is an isometric view of an energy saving indoor hot water heater to which embodiments of the present invention find particular applicability.

Turning now to the drawings, there is illustrated in FIG. 1 an indoor hot water heater 100 such as typically installed in dwellings in the North American market and to which embodiments of the micro-pilot system of the present invention provide particular benefit. The illustrated hot water heater includes a standby heat loss control system 102, such as that described in co-pending application Ser. No. 12/175,551, entitled SYSTEM AND METHOD TO REDUCE STANDBY ENERGY LOSS IN A GAS WATER HEATER, filed on Jul. 18, 2008 and assigned to the assignee of the instant application, the teachings and disclosure of which are hereby incorporated in their entireties by reference thereto. However, as will be discussed more fully below, embodiments of the present invention provide benefit to hot water heaters and other gas burning appliances that do not include such a standby heat loss control system as well. Indeed, it should be noted that while the following description will discuss various embodiments of the present invention, such embodiments and operative environments to which these embodiments find particular applicability are provided by way of example and not by way of limitation. For example, embodiments of the present invention may also find applicability in other gas burning appliances, e.g. a furnace, gas log, etc., which typically utilize a pilot to ignite a main burner.

Returning specifically to FIG. 1, the hot water heater 100 includes a cylindrical storage tank 106 for storing the water to be heated by the burner (not shown) located in the bottom 108 of the hot water heater 100. The housing 104 around the storage tank 106 is typically in the form of an insulated round jacket to prevent heat loss though the exterior surface. The heat from the burner is exchanged with the water in the storage tank via the flue pipe 110 that leads from the burner through the storage tank 106 to a draft diverter 112 located on the top of the hot water heater 100. The draft diverter 112 is positioned to collect the hot flue gases from the flue pipe 110, and is coupled to a pipe that is positioned to carry these flue gasses out of the dwelling in which the hot water heater 100 is installed.

In the illustrated hot water heater and as described more fully in the above referenced pending application, standby heat loss is substantially reduced by the inclusion of a damper actuator valve 114 that is located at the top of the hot water heater 100. A damper flapper valve crank shaft rod 116 driven by the damper actuator valve 114 is connected to a damper flapper valve 118 located on the flue pipe 110. This damper flapper valve 118 is used to close off the flue pipe 110 when the burner is off. The shape of the damper flapper valve 118 is normally round to close off the typical round flue pipe 110, although it would be square to close off square ducting, etc.

As may be seen in FIG. 1, the safety relay valve 122 is positioned between the hot water heater's combination gas controller 130 and the burner (not shown). Specifically, the outlet gas feed pipe 132 from the combination gas controller 130 is now connected to the safety relay valve 122, which in turn connected is to the burner feed pipe 134 which leads to the burner.

Figure 2:
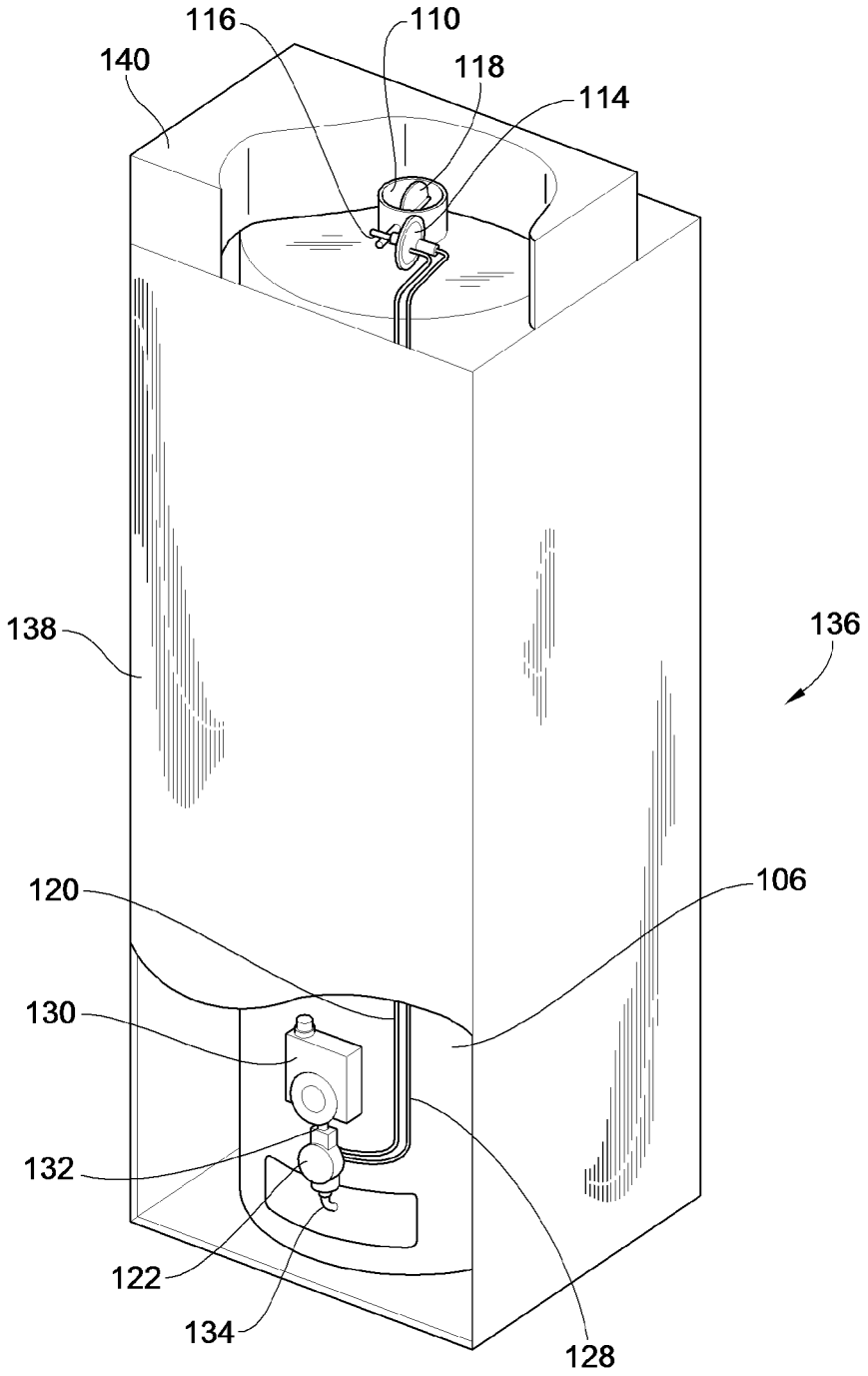
FIG. 2 is an isometric view of an square outdoor energy saving water heater to which embodiments of the present invention find particular applicability.

As discussed above, markets outside of North America, such as in Australia, install their hot water heaters outside of the dwellings. An embodiment of one such outdoor hot water heater 136 is illustrated in FIG. 2. The outdoor hot water heater 136 includes the cylindrical storage tank 106 housed in a rectangular jacket 138. A balanced flue terminal 140 is located on the top to collect the hot flue gases and disperse them from the front of the hot water heater 136.

The damper actuator valve 114 is located inside the terminal 140, attached to the outside of the transfer duct, which is adjacent to the heater flue pipe as it exits into the transfer duct (show in this illustration as 110 for ease of understanding). In this embodiment the damper actuator valve 114 is located close to the cylinder flue pipe 110 outlet in order to reduce standing losses. It should also be located either outside the terminal 140 away from the fresh air inlet or alternately be positioned in the terminal 140 but located so as not to create any turbulence under windy condition, e.g. in a static wind pocket within the terminal 140.

The damper flapper valve 118 to closed off the flue pipe 110 is located immediately over the outlet of the flue pipe 110 inside the transfer duct and is in communication with the damper actuator valve 114 via the damper flapper valve crank shaft rod 116. Small bore piping 120, 128 is used to connect the safety relay valve 122 to the damper actuator valve 114 as in the previous illustration. The outlet gas feed pipe 132 from the combination gas controller 130 is now connected to the safety relay valve 122, which in turn connected is to the burner feed pipe 134 on supply gas to the burner. The tank 106 is insulated within the square jacket 138, which also provides internal pathways for the air to be transferred from the top terminal 140 to the burner at the bottom of the appliance.

Figure 3:
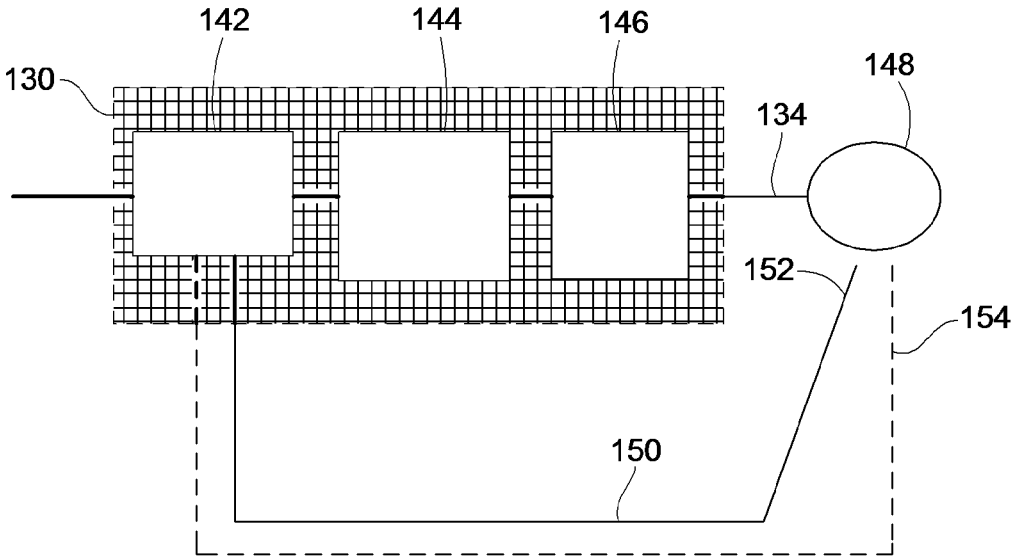
FIG. 3 is a block diagrammatic view of functional activity of primary gas and pilot control components of the gas control system of a typical storage hot water heater.

To help understand the control of the water heater, an understanding of a typical water heater combination gas controller 130 must first be had. To aid this, attention is now directed to the block diagram of FIG. 3, which illustrates the functional activity blocks of a standard combination water heater combination gas controller 130. The combination gas controller 130 incorporates in activity block 142 an off/pilot/on valve, pilot electro magnetic safety valve thermocouple system and a pilot regulator. The combination gas controller 130 also includes a thermostat 144 to control the gas to the burner 148 to heat up the water to a predetermined temperature, and a gas regulator 146 to regulate pressure to the main burner 148. To establish a safe pilot flame for burner ignition, functional activity block 142 supplies gas via a pilot feed pipe 150 to the pilot 152. A flame sensor 154, such as a thermocouple, is used to sense the presence of flame at the pilot 152 as a feedback to block 142. As discussed above, the amount of gas supplied by activity block 142 to the pilot 152 is the same during its operation, both in standby mode and during the ignition of the main burner 148.

Figure 4:
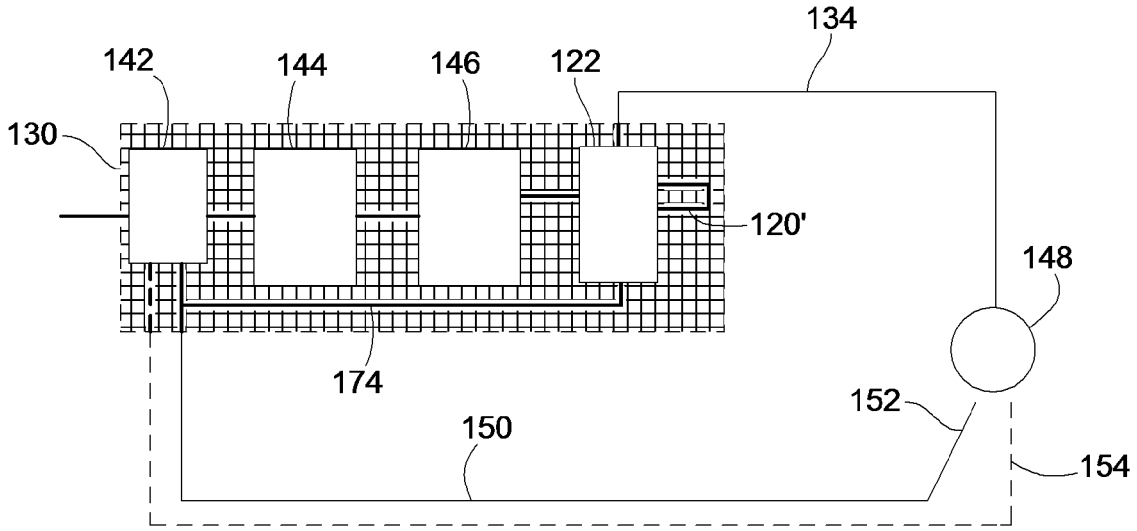
FIG. 4 is a block diagrammatic view of functional activity components of one embodiment of the micro-pilot control system for a storage hot water heater utilizing bypass gas to boost the size of the pilot just prior to flowing gas to the burner for ignition.

With this basic understanding in mind, attention is now directed to FIG. 4, which illustrates an embodiment of the micro-pilot system of the present invention. It should be noted, however, that while this description and illustration show the safety relay valve 122 located outside of the housing of the combination gas controller 130, other embodiments of the present invention include the safety relay valve 122 within the same housing as the combination gas controller 130 (which refers to the functional elements and not the packaging thereof). As such, in the following description and claims, when the safety relay valve 122 is described as being installed between the combination gas controller 130 and the burner 148, this is a functional description and not a physical one, i.e. the safety relay valve 122 may be packaged within the same housing of the combination gas controller 130 or outside of the housing of the combination gas controller 130.

In either physical layout, the safety relay valve 122 provides bleed gas to the pilot 152 in addition to the gas provided by functional activity block 142 when the thermostat 144 calls for heat. In this way, and as will be discussed in greater detail below, the means for ensuring ignition of the burner conserves energy and produces much less greenhouse gas over its lifetime as compared with the system illustrated in FIG. 3. In the embodiment of FIG. 4, the safety relay valve 122 is connected internally within the combination gas controller 130 as in an original equipment manufacturer (OEM) configuration. However, as discussed above, the safety relay valve 122 may be connected in an aftermarket configuration external to the combination gas controller 130, such as illustrated in FIGS. 1 and 2. Regardless of the physical location of the safety relay valve 122, one of its function is to boost the pilot gas pressure using bleed gas and consequently the flame size of the pilot 152, which can now be operated as a micro-pilot during standby operation, prior to ignition of the main burner.

In the illustrated embodiment relay gas valve uses small bore piping 120' to direct the bypass gas to the proper chamber within the safety relay valve 122 as will be made clear below. However, it should be noted that this function distribution of bypass bleed gas may be provided by internal plumbing within the safety relay valve 122 in other embodiments. This embodiment in FIG. 4 also illustrates that the booster pilot gas connection 174 is connected internal to the combination gas controller 130 to the pilot gas pipe 150 to boost the miro-pilot gas pressure and provide a larger pilot flame for ignition of the main burner 148. In this respect the illustrated embodiment provides a combined micro-pilot and a booster pilot (152) providing the dual function when the bleed gas is internally connected to the pilot feed pipe 150. In an aftermarket configuration, a flow restrictor may be installed in or a smaller diameter pilot gas pipe 150 may be used upstream of the connection of the booster pilot gas connection 174 so as to reduce the pilot flame from that which the combination gas controller 130 would normally produce.

Figure 5:
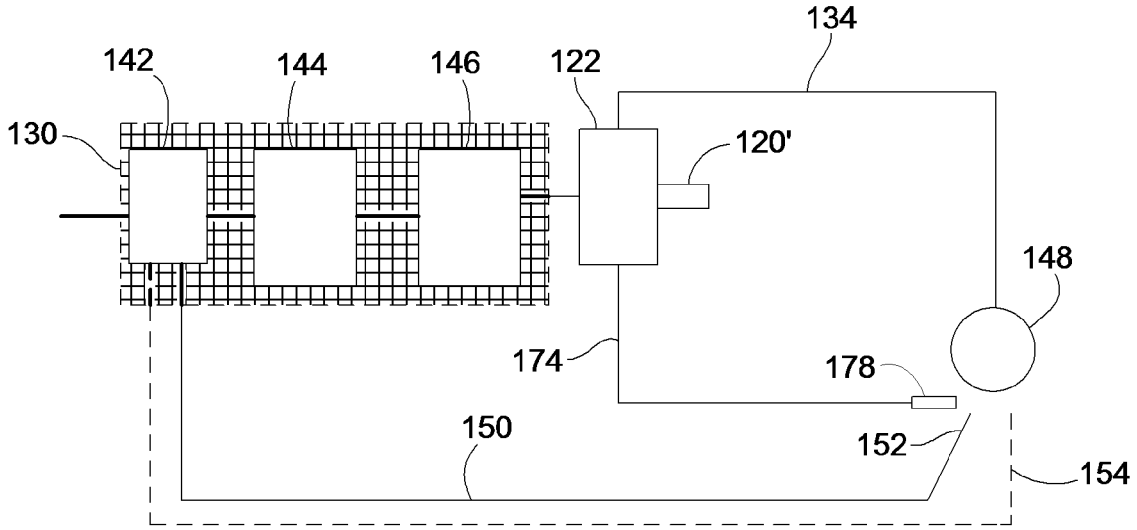
FIG. 5 is a block diagrammatic view of functional activity components of another embodiment of the micro-pilot control system for a storage hot water heater that supplies bypass gas to a booster pilot just prior to flowing gas to the burner for ignition.

In the embodiment illustrated in FIG. 5, the safety relay valve 122 is not included as part of the combination gas controller 130. Further, the booster pilot gas connection 174 is not connected to the pilot feed pipe 150, but the means for ensuring ignition of the burner instead includes a separate booster pilot 178. In such an embodiment, the amount of gas supplied by functional block 142 to the micro pilot 152 can be reduced substantially over conventional pilots since it is no longer required to ignite the main burner 148. Instead, it will only be used to ignite the booster pilot 178 just prior to flowing gas to the main burner 148. The booster pilot will actually provide the flame to ignite the main burner 148. As with the previous embodiment, the safety relay valve 122 may be integrated into the combination gas controller 130, particularly in OEM configurations.

Figure 6:
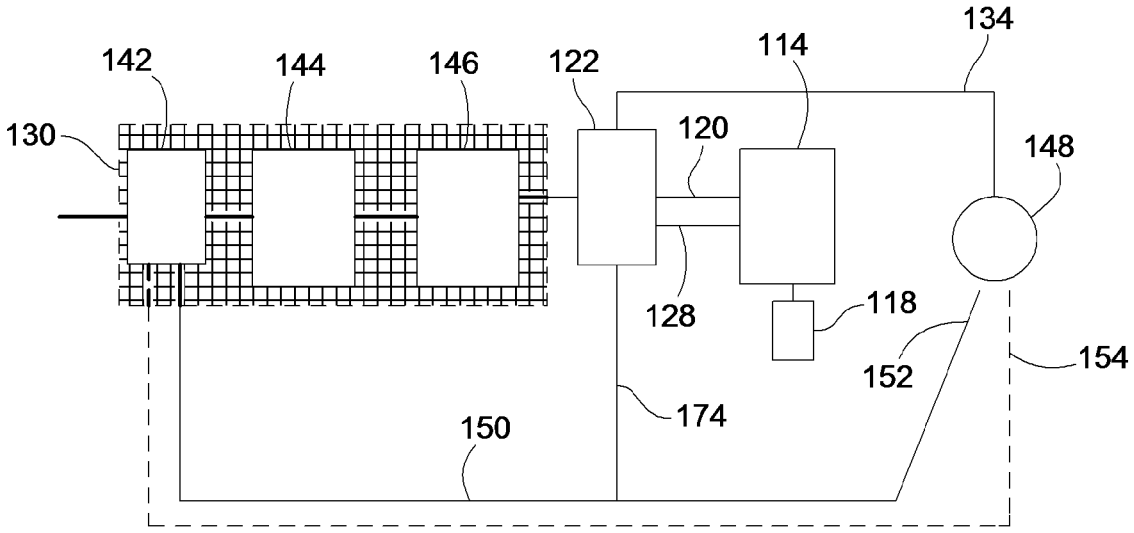
FIG. 6 is a block diagrammatic view of functional activity components of another embodiment of the micro-pilot control system for a storage hot water heater utilizing bypass gas from a standby energy loss prevention system to boost the size of the pilot just prior to flowing gas to the burner for ignition.

As illustrated in FIG. 6, the booster pilot gas connection 174 may be used to supply additional gas to the pilot feed pipe 150 to increase the pilot 152 flame just prior to opening of the main flow of gas to the burner 148 to aid in ignition thereof similar to the embodiment of FIG. 4. Unlike the embodiment of FIG. 4, the pilot control system is incorporated in a hot water heater that includes the standby energy reduction system described in the above identified pending application. In this embodiment, the combination gas controller 130 remains unchanged from that illustrated in FIG. 3 in configuration and operation. However, instead of having the gas regulator 146 coupled to the burner feed pipe 134, it is coupled to the safety relay valve 122, which is then coupled to the burner feed pipe 134. Small bore pipe 120, 128 is used to couple the safety relay valve 122 to the damper actuator valve 114 to drive the damper flapper valve 118. The bypass gas is provided to the pilot 152 only after the damper flapper valve 118 has been opened and prior to the safety relay valve 122 providing gas to the burner 148 via the burner feed pipe 134.

Figure 7:
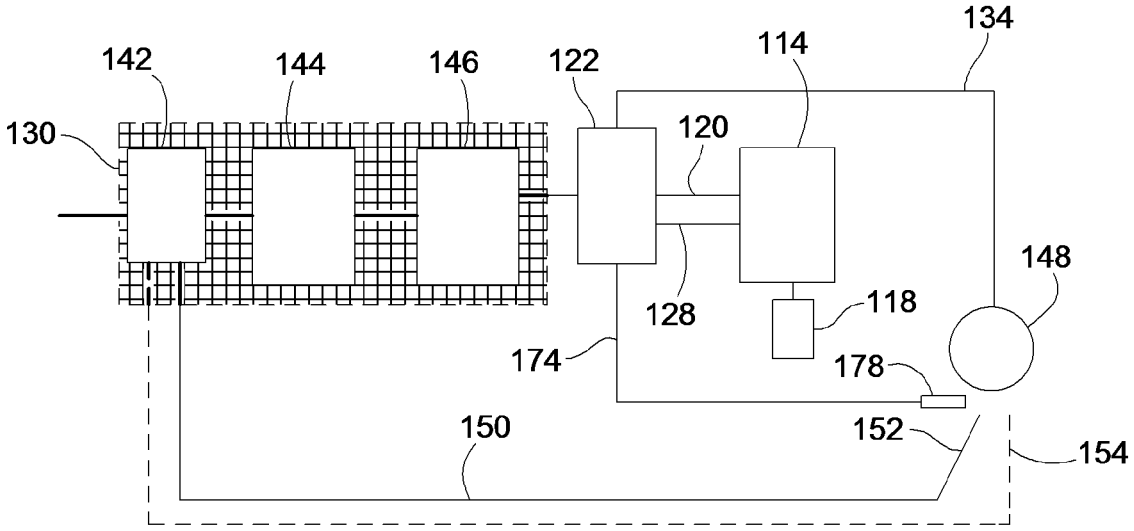
FIG. 7 is a block diagrammatic view of functional activity components of another embodiment of the micro-pilot control system for a storage hot water heater that supplies bypass gas from a standby energy loss prevention system to a booster pilot just prior to flowing gas to the burner for ignition.

In another embodiment as illustrated in FIG. 7, the booster pilot gas connection 174 is coupled to a booster pilot 178 in addition to the pilot 152. In such an embodiment, the pilot 152 is a micro pilot having a very small flame that is capable of igniting the gas flowing from the booster pilot gas connection 174 to the booster pilot 178, which is then used to ignite the main flow of gas to the burner 148.

Figure 8:
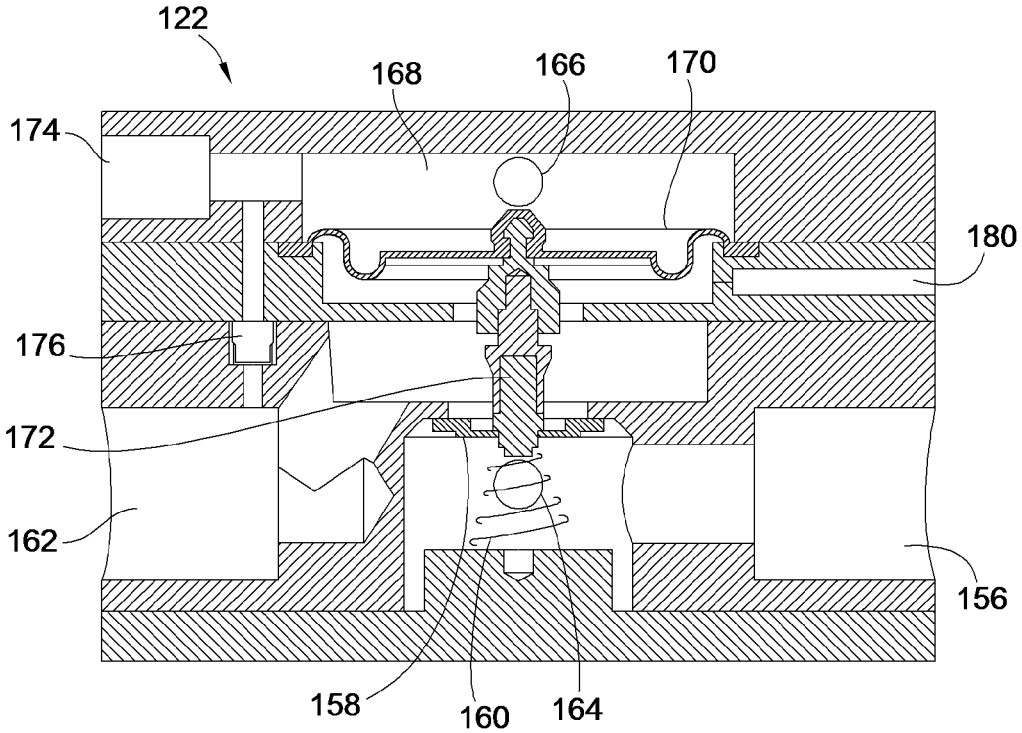
FIG. 8 is a diagrammatic cross section of a safety relay valve constructed in accordance with one embodiment of the present invention.

The details of one embodiment of a safety relay valve 122 are shown in the cross sectional illustration of FIG. 8. As may be seen, the safety relay valve 122 contains an inlet 156 to receive gas from the functional block 146 of combination gas controller 130. A main controlling valve 158 with a valve return spring 160 is positioned between the inlet 156 and the outlet 162. The inlet chamber of the safety relay valve 122 includes a first connection port 164 for supplying bleed gas via small bore piping 120 or 120' to second connection port 166 or the damper actuator valve 114 depending on the configuration of the particular embodiment in which it is used. The second connection port 166 for receiving bleed gas back from the damper actuator valve 114 via the small bore piping 120 or 128 is located in a diaphragm control chamber 168. As discussed above, one embodiment of the present invention provides internal passages as appropriate (not shown) without the need for external piping.

A diaphragm 170 is positioned within the diaphragm control chamber 168, and is operatively coupled to the main valve control shaft 172. Displacement of the diaphragm 170 based on pressure within the diaphragm control chamber 168 will operate to open or allow the main controlling valve 158 to close under pressure of spring 160 as will be discussed more fully below. Diaphragm vent passage 180 will prevent any net pressure build up below the diaphragm 170 during displacement thereof. Once the main controlling valve 158 has been opened, gas is allowed to flow from the inlet 156 through the outlet 162 to the burner via the burner feed pipe 134. The safety relay valve 122 also includes a booster pilot gas connection 174 for providing gas to a booster pilot (either the dual function pilot 152 or the separate booster pilot 178). To allow the safety relay valve 122 to be used in installations such as that described in the above identified application that do not use a booster pilot, the bleed gas from the second connection port 166 can be distributed internally through passage 176 down stream of the valve 158, to outlet 162. Indeed, base on the relative size of this passage 176 to the booster pilot gas connection 174, this passage 176 can be included in embodiments of the present invention, or may be eliminated.

Figure 9:
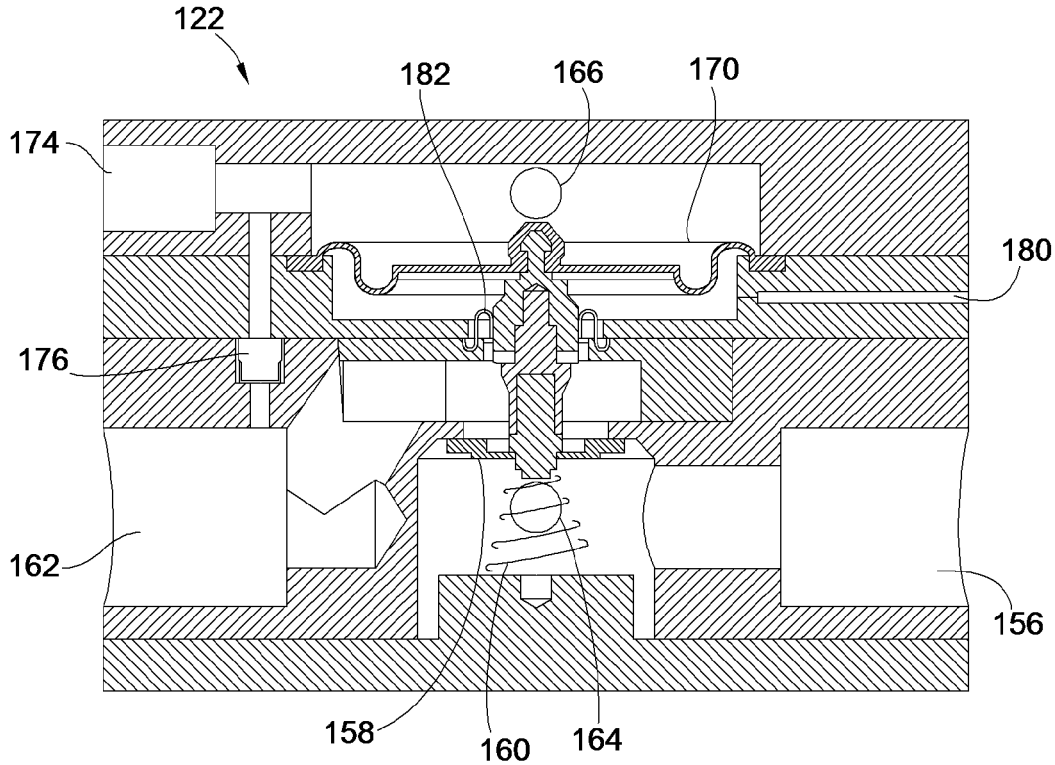
FIG. 9 is a diagrammatic cross section of an atmospheric compensated safety relay valve constructed in accordance with another embodiment of the present invention.

FIG. 9 illustrates another embodiment of the safety relay valve 122. In this embodiment, which is atmospherically compensated, the safety relay valve 122 provides improved gas pressure controlling performance at low inlet pressures. This embodiment is particularly useful when the gas pressure supplied to the hot water heater is low, e.g. as in installations in Australia that utilize natural gas. In addition to the components of the embodiment illustrated in FIG. 8, the safety relay valve 122 illustrated in FIG. 9 includes a diaphragm 170 to operate the main valve 158 which is smaller than a top bleed diaphragm 182. The design and size of orifices within the bleed system (which defines the size of the booster pilot if utilized and how fast the valves open and close) should be such as to ensure the valves close tightly against extremes of high and low gas pressures likely to be encountered.

Figure 10:
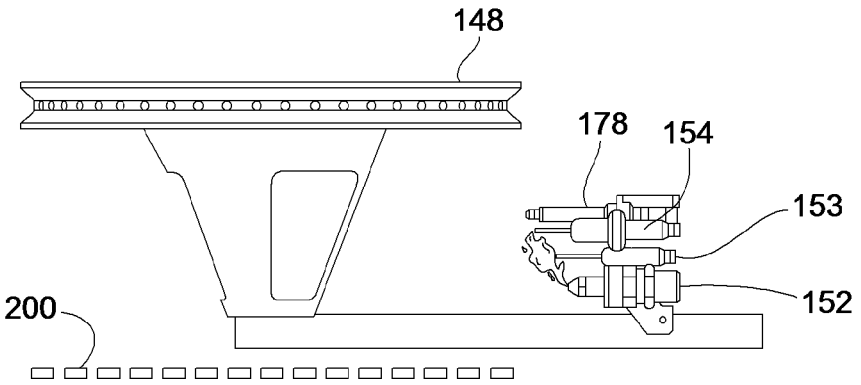
FIG. 10-12 are diagrammatic illustrations of an ignition sequence of an embodiment of the present invention utilizing a micro-pilot and separate booster pilot.

Turning now to FIG. 10, there is illustrated an embodiment of the pilot 152 of the present invention configured to serve as a micro-pilot to ignite the booster pilot 178, which is used to ignite the burner 148. The micro-pilot flame, which is substantially smaller than a conventional hot water heater pilot, is ignited by a spark from piezo probe 153 upon the first time commissioning. This micro pilot flame is sensed by thermocouple 154 as discussed above. In this FIG. 10, the micro pilot 152 is lit, i.e. the hot water heater is in standby mode with the thermostat satisfied. The size of the miro-pilot flame, for example, may be approximately 50% of a normal pilot flame because it does not need to ignite the main burner 148, thus saving energy and reducing the amount of greenhouse gas generated over the life of the hot water heater. Also, since the micro pilot 152 no longer need to ignite the burner 148, it can be located closer to the flame trap 200. This allows for smoother ignition of the flammable vapor should a gasoline spill occur, but at the same time allows for a reduction in the pilot size to micro size.

Besides the energy savings that the micro size pilot 152 provides, the life of the low mass thermocouple 154 is extended due to less burn out from the smaller micro-pilot flame. The micro pilot 152 also allows for faster heat up times because the low mass thermocouple 154 may now be more accurately positioned within the flame front of the micro-pilot flame for stable performance. Faster drop out times are also provided because with the low mass thermocouple 154 being positioned within the flame front, the gas issuing from the micro-pilot 152 will help cool the thermocouple 154 tip faster.

Figure 11:
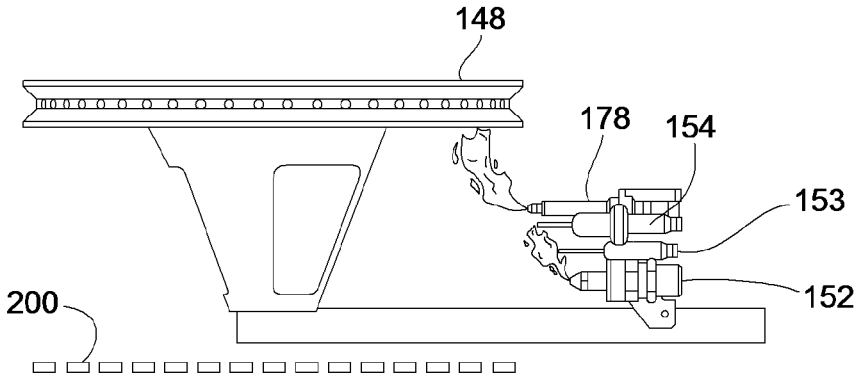

Once the safety relay valve has received the main gas flow, but before it opens its main controlling valve 158 (see FIG. 8), bypass bleed gas is allowed to flow to the booster pilot 178 where it is ignited by the micro pilot 152. This is shown in FIG. 11. In a system configuration that includes the standby energy loss prevention system, the bleed gas has opened the damper flapper valve 118 and damper safety valve and has started to pressurize the safety relay valve diaphragm 170. The water heater thermostat 144 is open allowing gas to the safety relay valve inlet 156 but the main controlling valve 158 is not yet open to allow gas to pass through the safety relay valve 122 on its way to the burner 148. The size of the booster flame is bigger than the micro-pilot flame. The additional heat from the booster pilot flame is added to the heat produced when the main burner 148 is on. In actuating the safety relay valve 122, and the damper flapper valve 118 in embodiments that utilize the standby energy loss prevention system, the volume of the bleed gas should be larger than the pilot booster gas rate to force pressurisation of the diaphragm 170.

Figure 12:
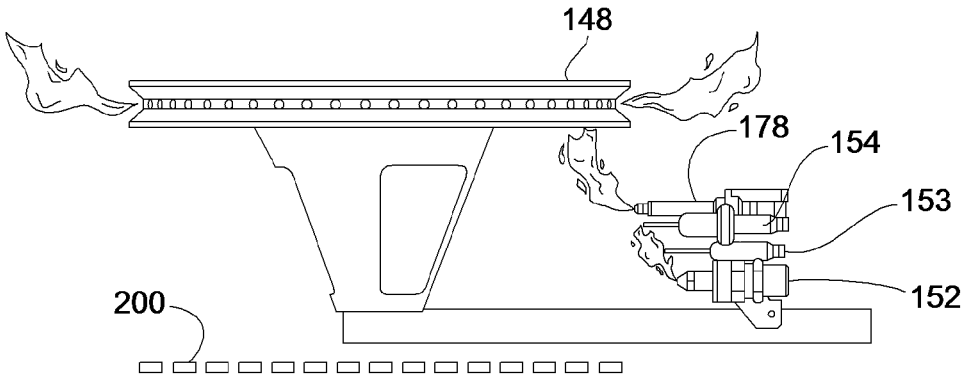

FIG. 12 illustrates the burner 148 condition once the safety relay valve 122 has opened the main controlling valve 158 and gas is allowed to flow to the burner 148. That is, the bleed gas has displaced the diaphragm 170 in the safety relay valve 122, which has opened the main controlling valve 158, after the bleed gas has caused the damper flapper valve 118 to open the damper flapper valve 118 and damper safety valve. This burner on condition will continue until the thermostat 144 determines that the water has reached its set point temperature.

Once the thermostat 144 is satisfied, the combination gas controller 130 will disable the flow of gas to the safety relay valve 122. Without a supply of gas, the diaphragm control chamber 168 (see FIG. 8) loses pressure and the spring 160 closes the main controlling valve 158. Once the main controlling valve 158 is closed, the burner 148 and the booster pilot 178 are extinguished. In embodiments that include the standby energy loss prevention system, once the burner 148 is extinguished, the damper flapper valve 118 closes to reduce the amount of standby energy loss.

As will now be clear to those skilled in the art in view of the foregoing, operation of embodiments of the present invention provide significant advantages over prior pilot systems in operation. Such operation begins when the thermostat in combination gas controller 130 calls for heat, and the internal gas valve opens allowing gas to flow through the combination gas controller 130 and the outlet gas feed pipe 132 to the inlet of the closed safety relay valve 122. A bypass flow of gas is piped from the inlet of the safety relay valve 122 though the micro bore piping 120 to the damper actuator valve 114 in embodiments that utilize the standby energy loss prevention system. If such a system is not used, the bypass gas is provided directly to the damper control chamber 168. The size of the micro bore piping 120 or the passage from the first connection port 164 to the second connection port 166 may vary somewhat, and is preferable in the range of about 3 mm to 5 mm aluminium tube for typical hot water heater installations.

The damper actuator valve 114 is pressurised by the bypass gas, forcing the damper flapper valve 118 to open. Continued flow of bypass gas to the damper actuator valve 114 will eventually drag the damper safety valve off its seat. As discussed above, the design is such that gas will not issue through the damper safety valve until the damper flapper valve 118 is sufficiently open for good combustion. The opened damper safety valve allows the gas to bleed from the damper actuator valve 114, through micro bore piping 128 back down to the top side of the diaphragm 170 in the safety relay valve 122. The flow of bypass gas from the damper actuator valve 114 is at a faster rate than issues from the booster pilot outlet 174, thus pressurizing the safety relay valve 122 diaphragm control chamber 168. The bleed gas starts to pressurize the relay diaphragm 170 and is also bled to the booster pilot 178 which ignites from the micro-pilot 152 in such embodiments that includes a booster pilot 178 (see FIGS. 5, 7), or increases the gas flow to the pilot 152 in embodiments that include this feature (see FIGS. 4, 6).

Once the safety relay valve 122 is finally pressurized, its main controlling valve 158 is forced open against the gas pressure and return spring force. Gas then issues to the main burner 148 via the burner feed pipe 134, where it is ignited by the pilot 152 or booster pilot 178. Gas continues to bleed from the top side of the diaphragm 170 of the safety relay valve 122 and continues to be burnt in the combustion chamber when the main burner 148 is on.

Once the combination gas controller 130 determines that the water temperature has reached its set point temperature, it turns off all gas to the safety relay valve 122. Gas drains out of the damper of the damper actuator valve 114 where upon the return spring, returns the push rod 192 to the original position rotating the crankshaft 190 which closes the damper flapper valve 118 and damper safety valve inside the damper actuator valve 114. Gas continues to drain from the damper safety valve bypass and from the diaphragm chamber of the safety relay valve 122, which allows the return spring to close off the main gas valve thus stopping all gas to the burner. The burner main flame is extinguished as well as the booster pilot leaving only the pilot or micro-pilot on.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A micro pilot for a gas burning appliance having a combination gas controller controlling a first flow of gas to a pilot via a pilot feed pipe and providing a micro-pilot flame and a second flow of gas to a burner, the micro-pilot flame being of smaller intensity than an ignition flame, the ignition flame being of sufficient intensity for igniting the second flow of gas comprising:

a safety relay valve interposed between the combination gas controller and the burner, the safety relay valve having a housing forming an inlet for receiving gas when the combination gas controller enables combustion, an outlet for providing gas to the burner, a first connection port in fluid communication with the inlet, a diaphragm control chamber, a booster pilot gas connection outlet in fluid communication with the diaphragm control chamber, and a second connection port in fluid communication with the diaphragm control chamber, the safety relay valve further including a main controlling valve positioned between the inlet and the outlet to control a flow of gas from the inlet to the outlet, the main controlling valve including a valve control shaft drivably coupled to a diaphragm positioned in the diaphragm control chamber; and a means for ensuring ignition of the burner coupled to the booster pilot gas connection outlet, the means being operative to produce an ignition flame that is of greater intensity than the micro-pilot flame and being of sufficient intensity to ignite the second flow of gas to the burner just prior to the safety relay valve opening the main controlling valve to allow the second flow of gas to flow to the burner.

2. The micro pilot of claim 1, wherein the means for ensuring ignition supplies a third flow of gas to the pilot feed pipe to increase a size of a pilot flame produced by the pilot.

3. The micro pilot of claim 2, wherein the first connection port and the second connection port are in fluid communication via external micro piping.

4. The micro pilot of claim 2, wherein the first connection port and the second connection port are in fluid communication via a passage formed in the housing of the safety relay valve.

5. The micro pilot of claim 2, further comprising:

a damper actuator valve having an inlet in fluid communication with the first connection port and an outlet in fluid communication with the second connection port; and a damper flapper valve operatively coupled to the damper actuator valve and installed on the gas burning appliance in proximity to a top end of a flue pipe such that closure of the damper flapper valve reduces thermal communication from the flue pipe to an environment.

6. The micro pilot of claim 1, wherein the means for ensuring ignition comprises a booster pilot positioned in proximity to the pilot and the burner and in fluid communication with the booster pilot gas connection.

7. The micro pilot of claim 6, wherein the first connection port and the second connection port are in fluid communication via external micro piping.

8. The micro pilot of claim 6, wherein the first connection port and the second connection port are in fluid communication via a passage formed in the housing of the safety relay valve.

9. The micro pilot of claim 6, further comprising:

a damper actuator valve having an inlet in fluid communication with the first connection port and an outlet in fluid communication with the second connection port; and a damper flapper valve operatively coupled to the damper actuator valve and installed on the gas burning appliance in proximity to a top end of a flue pipe such that closure of the damper flapper valve reduces thermal communication from the flue pipe to an environment.

10. The micro pilot of claim 6, further comprising a flame sensor positioned to sense a presence of flame from the pilot.

11. The micro pilot of claim 1, wherein upon receipt of gas at the inlet of the safety relay valve a small amount of bypass gas flows from the first connection port to the second connection port of the safety relay valve, and wherein the bypass gas flows to the means for ensuring ignition and at the same time begins to cause a displacement in the diaphragm of the safety relay valve which linearly translates the valve control shaft to open the main controlling valve to allow gas to flow from the inlet of the safety relay valve to the outlet of the safety relay valve.

12. A hot water heater, comprising:

a storage tank having a burner positioned at a bottom thereof;

a pilot positioned in proximity to the burner;

a combination gas controller including a thermostat for sensing a temperature of water in the storage tank and for controlling a flow of gas from an external source to enable combustion when the temperature is below a threshold and to disable combustion when the threshold is met, the combination gas controller providing a first flow of gas to the pilot via a pilot feed pipe and providing a micro-pilot flame and a second flow of gas to the burner, the micro-pilot flame being of smaller intensity than an ignition flame, the ignition flame being of sufficient intensity for igniting the second flow of gas;

a safety relay valve interposed between the combination gas controller and the burner, the safety relay valve having a housing forming an inlet for receiving gas from the combination gas controller when the combination gas controller enables combustion, an outlet for providing gas to the burner, a first connection port in fluid communication with the inlet, a diaphragm control chamber, a booster pilot gas connection outlet in fluid communication with the diaphragm control chamber, and a second connection port in fluid communication with the diaphragm control chamber, the safety relay valve further including a main controlling valve positioned between the inlet and the outlet to control a flow of gas from the inlet to the outlet, the main controlling valve including a valve control shaft drivably coupled to a diaphragm positioned in the diaphragm control chamber; and a means for ensuring ignition of the burner coupled to the booster pilot gas connection outlet, the means being operative to produce an ignition flame that is of greater intensity than the micro-pilot flame and being of sufficient intensity to ignite the second flow of gas to the burner just prior to the safety relay valve opening the main controlling valve to allow the second flow of gas to flow to the burner.

13. The hot water heater of claim 12, wherein the means for ensuring ignition supplies a third flow of gas to the pilot feed pipe to increase a size of a pilot flame produced by the pilot.

14. The hot water heater of claim 13, further comprising:

a flue pipe for exhausting combustion gases passing through the storage tank and in thermal communication with water stored therein;

a damper actuator valve having an inlet in fluid communication with the first connection port and an outlet in fluid communication with the second connection port; and a damper flapper valve operatively coupled to the damper actuator valve and installed in proximity to a top end of the flue pipe such that closure of the damper flapper valve reduces thermal communication from the flue pipe to an environment.

15. The hot water heater of claim 14, wherein upon receipt of gas at the inlet of the safety relay valve a small amount of bypass gas flows from the first connection port to an inlet of the damper actuator valve, and wherein the bypass gas causes the damper actuator valve to open the damper flapper valve, and wherein after the damper flapper valve is opened the damper actuator valve allows the bypass gas to flow from an outlet of the damper actuator valve to the second connection port of the safety relay valve, and wherein the bypass gas flows to the pilot to increase a flame produced thereby and at the same time causes a displacement in the diaphragm of the safety relay valve which linearly translates the valve control shaft to open the main controlling valve to allow gas to flow from the inlet of the safety relay valve to the outlet of the safety relay valve.

16. The hot water heater of claim 12, wherein the means for ensuring ignition comprises a booster pilot positioned in proximity to the pilot and the burner and in fluid communication with the booster pilot gas connection.

17. The hot water heater of claim 16, further comprising a thermocouple positioned in proximity to the pilot to sense a presence of flame from the pilot.

18. The hot water heater of claim 16, further comprising:

a flue pipe for exhausting combustion gases passing through the storage tank and in thermal communication with water stored therein;

a damper actuator valve having an inlet in fluid communication with the first connection port and an outlet in fluid communication with the second connection port; and a damper flapper valve operatively coupled to the damper actuator valve and installed in proximity to a top end of the flue pipe such that closure of the damper flapper valve reduces thermal communication from the flue pipe to an environment.

19. The hot water heater of claim 18, wherein upon receipt of gas at the inlet of the safety relay valve a small amount of bypass gas flows from the first connection port to an inlet of the damper actuator valve, and wherein the bypass gas causes the damper actuator valve to open the damper flapper valve, and wherein after the damper flapper valve is opened the damper actuator valve allows the bypass gas to flow from an outlet of the damper actuator valve to the second connection port of the safety relay valve, and wherein the bypass gas flows to the booster pilot and at the same time causes a displacement in the diaphragm of the safety relay valve which linearly translates the valve control shaft to open the main controlling valve to allow gas to flow from the inlet of the safety relay valve to the outlet of the safety relay valve.

20. The hot water heater of claim 12, wherein upon receipt of gas at the inlet of the safety relay valve a small amount of bypass gas flows from the first connection port to the second connection port of the safety relay valve, and wherein the bypass gas flows to the means for ensuring ignition and at the same time begins to cause a displacement in the diaphragm of the safety relay valve which linearly translates the valve control shaft to open the main controlling valve to allow gas to flow from the inlet of the safety relay valve to the outlet of the safety relay valve.

* * * * *